US010247393B2

(12) United States Patent
Clark et al.

(10) Patent No.: US 10,247,393 B2
(45) Date of Patent: Apr. 2, 2019

(54) REMOVABLE LED MODULE WITH TILTING ADJUSTMENT MECHANISM

(71) Applicant: ABL IP Holding LLC, Decatur, GA (US)

(72) Inventors: Stephen H. Clark, Downers Grove, IL (US); Joseph Stauner, Algonquin, IL (US)

(73) Assignee: ABL IP Holding LLC, Atlanta, GA (US)

( * ) Notice: Subject to any disclaimer, the term of this patent is extended or adjusted under 35 U.S.C. 154(b) by 334 days.

(21) Appl. No.: 15/147,757

(22) Filed: May 5, 2016

(65) Prior Publication Data

US 2016/0327251 A1 Nov. 10, 2016

Related U.S. Application Data

(60) Provisional application No. 62/158,010, filed on May 7, 2015.

(51) Int. Cl.

| | |
|---|---|
| ***F21S 8/02*** | (2006.01) |
| ***F21V 17/12*** | (2006.01) |
| ***F21V 19/02*** | (2006.01) |
| ***F21V 21/04*** | (2006.01) |
| ***F21V 21/30*** | (2006.01) |
| ***F21V 29/83*** | (2015.01) |
| ***F21Y 115/10*** | (2016.01) |

(52) U.S. Cl.

CPC ..... *F21V 19/02* (2013.01); *F21S 8/026* (2013.01); *F21V 21/044* (2013.01); *F21V 21/048* (2013.01); *F21V 17/12* (2013.01); *F21V 21/30* (2013.01); *F21V 29/83* (2015.01); *F21Y 2115/10* (2016.08)

(58) Field of Classification Search

CPC ..... F21V 19/02; F21V 21/044; F21V 21/048; F21V 21/30; F21V 29/83; F21V 17/12; F21S 8/026; F21Y 2115/10

See application file for complete search history.

(56) References Cited

U.S. PATENT DOCUMENTS 8,403,533 B1 * 3/2013 Paulsel ..... F21S 8/026 362/249.02
9,657,933 B2 * 5/2017 Clark ..... F21V 29/763

(Continued)

OTHER PUBLICATIONS

Office Action for Canadian Application No. CA 2,929,209, dated Jan. 10, 2018, 4 pages.

(Continued)

*Primary Examiner* — Mary Ellen Bowman

(74) *Attorney, Agent, or Firm* — Kilpatrick Townsend & Stockton LLP

(57) ABSTRACT

A recessed lighting unit includes a light engine and provides angular adjustment of the light emanating from the lighting unit. In one arrangement, the lighting unit includes a heat sink and a module frame that slidingly interact to provide rotation of the light engine in one degree of freedom, for example rotation about a horizontal axis. A rotation mechanism may also be provided for rotating the light engine in a second degree of freedom, for example rotation about the axis of a cylindrical recessed can in which the light engine is disposed. The lighting unit may be configured for use in new construction, or for retrofit applications.

19 Claims, 14 Drawing Sheets

(56) References Cited

U.S. PATENT DOCUMENTS

| | | | | |
|---|---|---|---|---|
| 2011/0063837 | A1* | 3/2011 | Rizkin | F21V 19/001 362/235 |
| 2012/0307486 | A1 | 12/2012 | Gordin et al. | |
| 2015/0219317 | A1* | 8/2015 | Littman Gatof | F21V 21/30 362/372 |
| 2015/0252988 | A1* | 9/2015 | Rashidi Doust | F21V 21/049 362/285 |

OTHER PUBLICATIONS

"Aculux 2-Inch LED Precision Luminaires," Available online at http://www.junolightinggroup.com/Whats_New/New_Products/Aculux_2-Inch_LED_Precision_Luminaires?alttemplate=newsArticle2, Feb. 18, 2015, 3 pages.

Retrofit, "High-power LED Light Engine is for Track, Semi-recessed and Recessed Luminaires," Available online at http://retrofitmagazine.com/high-pcMter-led-light-engine-is-for-track-semi-recessed-and-recessed-luminaires/, Mar. 11, 2015, 5 pages.

CA 2,929,209, "Office Action," dsted Sep. 26, 2018, 4 pages.

* cited by examiner

REMOVABLE LED MODULE WITH TILTING ADJUSTMENT MECHANISM

This application claims the benefit of U.S. Provisional Patent Application No. 62/158,010 filed May 7, 2015 and titled "Removable LED Module with Tilting Adjustment Mechanism", the entire disclosure of which is hereby incorporated by reference herein for all purposes.

BACKGROUND OF THE INVENTION

Recessed can lights are commonly used in new construction and retrofit applications. Typically, a generally cylindrical "can" is recessed into a ceiling, and provides an enclosure for a light engine such as an incandescent or fluorescent bulb, or a light emitting diode (LED) light engine. Recessed can lighting has several advantages, including providing downlight in an unobtrusive manner, not encroaching into the room space, and being installable and serviceable from the room side of the ceiling, among others. Some recessed cans can be completely covered with insulation.

In some applications, a portion of the recessed can or its light engine may be tilted so that the light given off by the recessed can may wash a wall or shine on wall-mounted artwork, rather than being directed downward. Previous tilting mechanisms have been complex or have suffered from other disadvantages.

SUMMARY OF THE INVENTION

According to one aspect, a lighting unit comprises a light engine, which further comprises a light source and a heat sink attached to and in thermal communication with the light source. The heat sink comprises first and second arms defining an open channel between the first and second arms. The lighting unit further comprises a module frame shaped and sized to slide within the open channel of the heat sink. The module frame has first and second sides and defines a first pair of curved grooves in the first side of the module frame and a second pair of curved grooves in the second side of the module frame. The lighting unit further comprises at least four protrusions, two of the protrusions extending from the first arm of the heat sink and respectively engaging the first pair of curved grooves, and two of the removable protrusions extending from the second arm of the heat sink and respectively engaging the second pair of curved grooves. The light engine is tiltable with respect to the module frame by sliding the protrusions within the pairs of grooves.

DETAILED DESCRIPTION OF THE INVENTION

Figure 1:
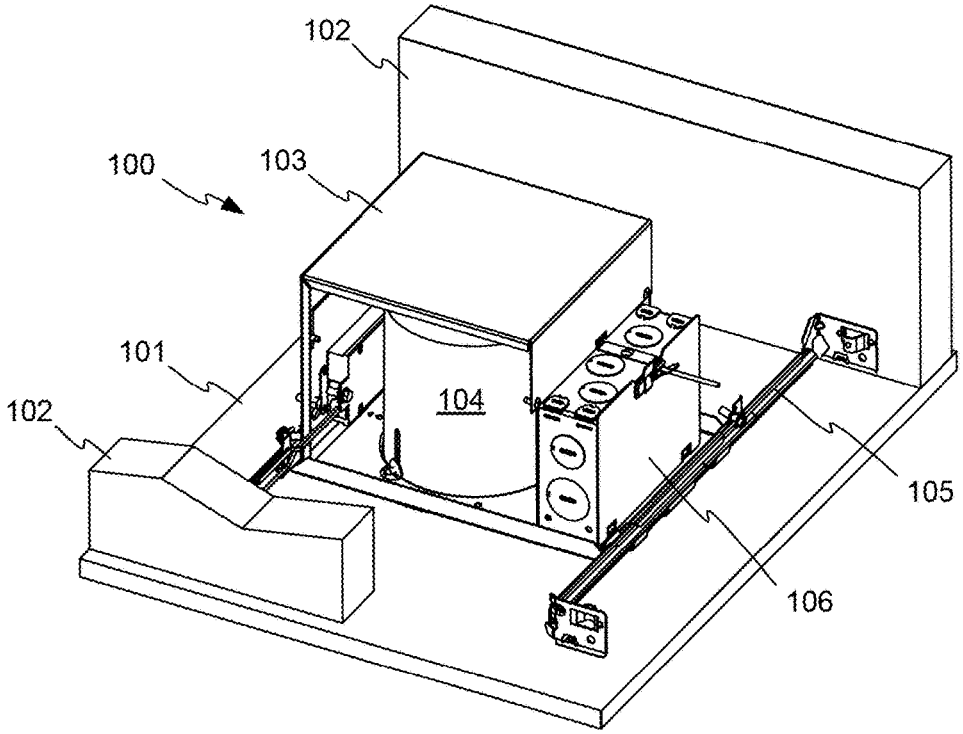
FIG. 1 illustrates an upper perspective view of a recessed lighting unit in accordance with embodiments of the invention.

FIG. 1 illustrates an upper perspective view of a recessed lighting unit 100 in accordance with embodiments of the invention. Lighting unit 100 is designed to reside above a ceiling 101, for example between joists 102. That is, lighting unit 100 is recessed into the ceiling. In the example of FIG. 1, lighting unit 100 may be especially suitable for use in new construction, and at least part of lighting unit 100 may be placed between joists 102 before ceiling 101 is installed.

Example lighting unit 100 includes an enclosure 103 (one panel of which has been omitted for clarity), enclosing a "can" 104, which in turn encloses a light engine and other elements described in more detail below. In some installations, enclosure 103 may be covered with insulation. Enclosure 103 may be provided with mounting features 105 and electrical enclosures 106 for convenient mounting to joists 102 and for safely enclosing electrical connections, as may also be required by building codes. Enclosure 103 may be made, for example, of sheet steel or another suitable material. The material of enclosure 103 is preferably fire resistant.

Figure 2:
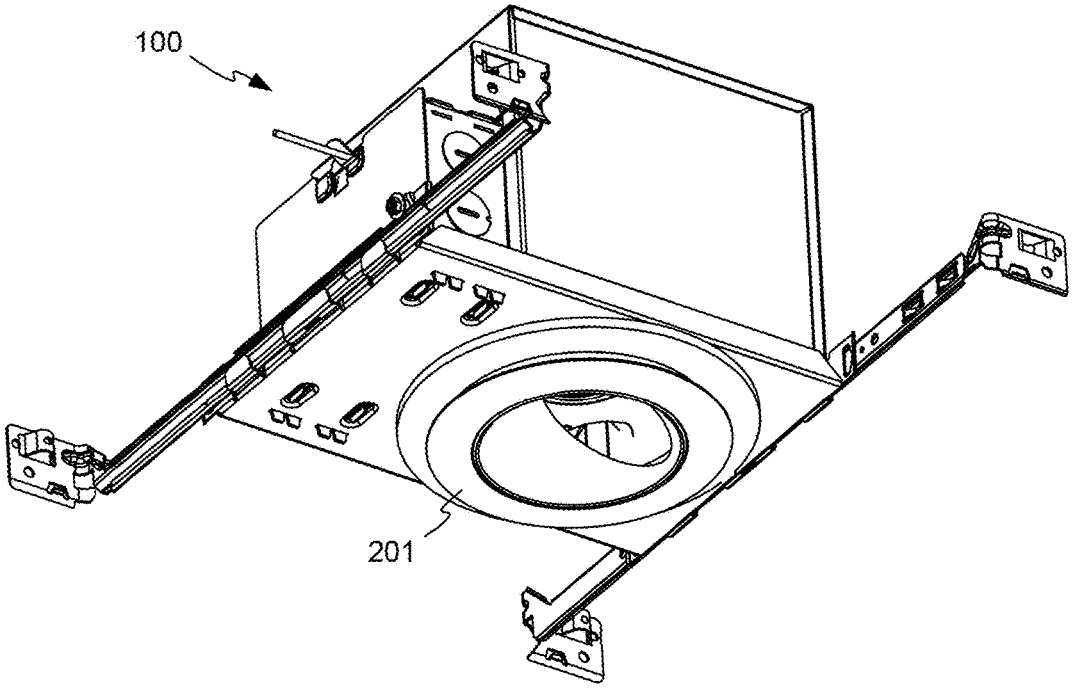
FIG. 2 illustrates a lower perspective view of the lighting unit of FIG. 1.

FIG. 2 illustrates a lower perspective view of lighting unit 100. Ceiling 101 and joists 102 have been removed from FIG. 2 for clarity of illustration. A trim 201 is installed at the bottom of can 104, through which light emanates to light the room below. Trim 201 may provide a decorative finished look to lighting unit 100, and may also include reflective surfaces to reflect light into a desired lighting pattern.

Figure 3:
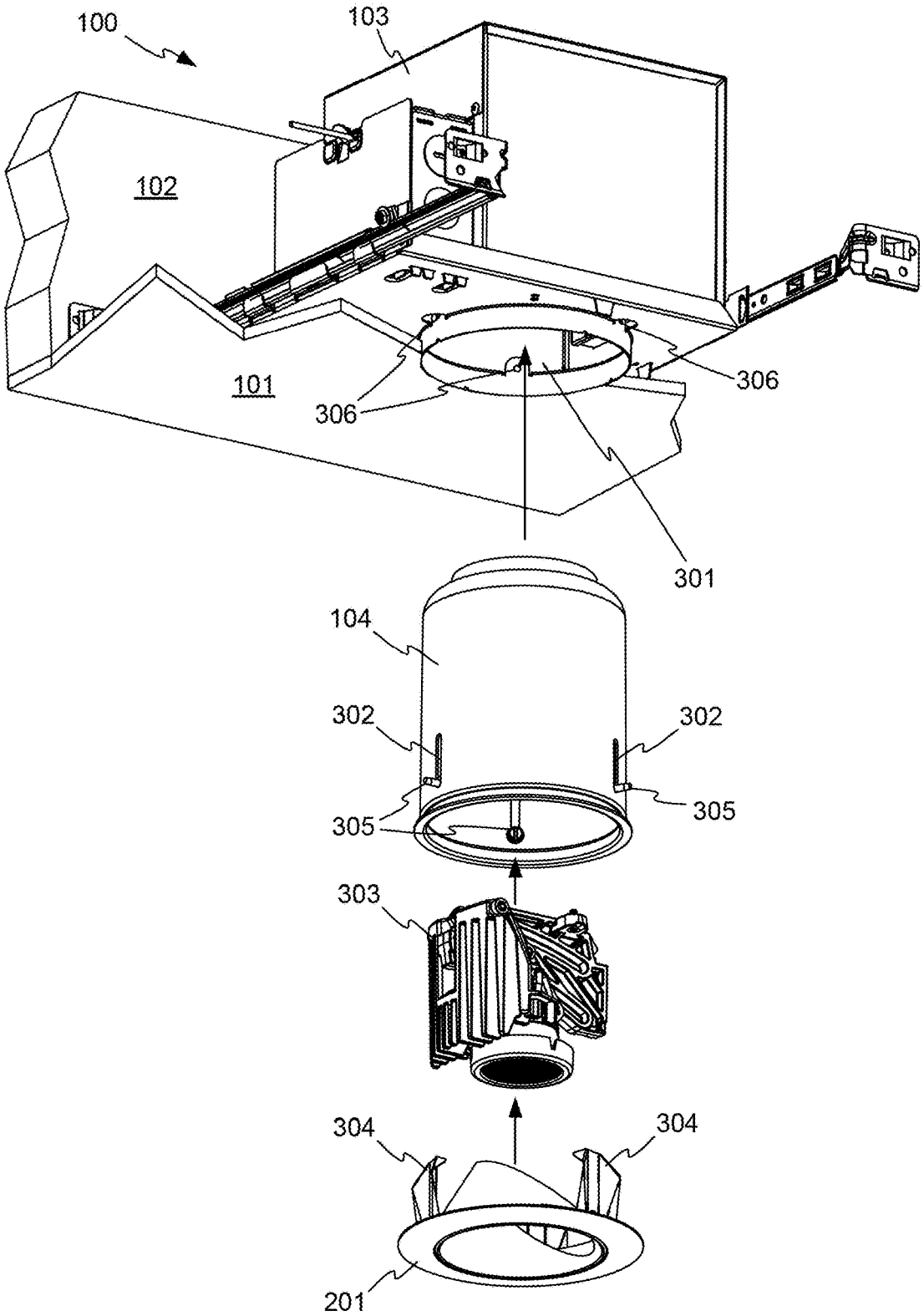
FIG. 3 is an exploded perspective view of the lighting unit of FIG. 1, showing additional elements.

FIG. 3 is an exploded perspective view of lighting unit 100, showing additional elements and a process of installation or servicing of lighting unit 100. Can 104 is inserted or removed through opening 301 in enclosure 103, and is secured to enclosure 103. Slots 302 in can 104 may permit adjustment of the height of can 104 with respect to ceiling 101, for example to ensure that trim 201 fits snugly against ceiling 101. The adjustability also allows setting the can to maintain a desired distance between a light source within lighting unit 100 and the bottom of ceiling 101 and trim 201, to improve light emission from lighting unit 100 and to reduce glare. To perform the adjustment, screws 305 may be inserted through slots 302 and into tabs 306 at the bottom of enclosure 103. Screws 305 slide within slots 302 while can 104 is adjusted in height. Once can 104 is at the desired height, screws 305 may be tightened to secure can 104 at the selected height.

A tiltable light engine module 303 is inserted into can 104, and may be secured in a manner described in more detail below. Trim 201 may then be inserted into can 104 to finish the installation. Trim 201 may be held in place by spring steel friction clips 304 that slidingly engage the inner wall of can 104.

Figure 4:
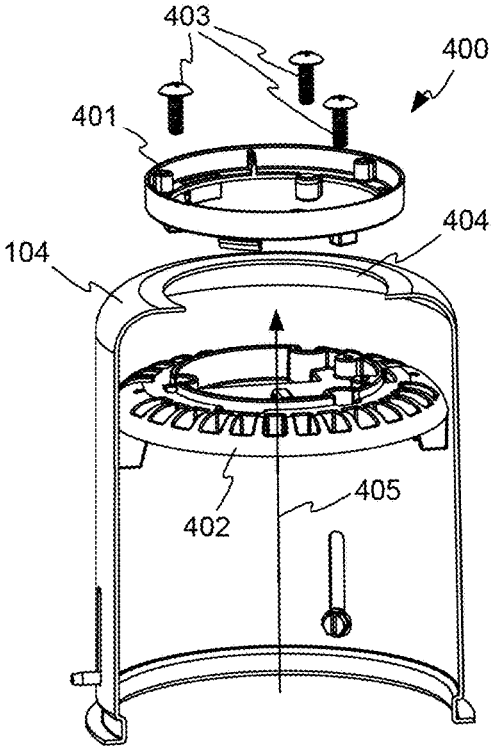
FIG. 4 is an upper partially-cutaway perspective view of a can, including a rotation mechanism in accordance with embodiments of the invention.
Figure 5:
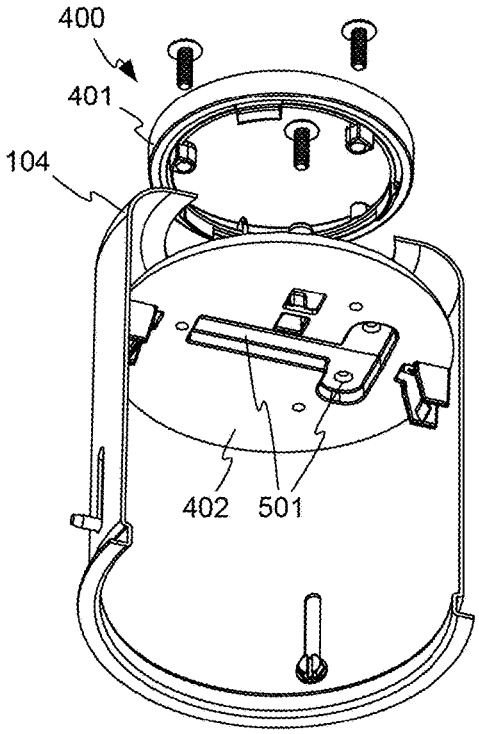
FIG. 5 is a lower partially-cutaway perspective view of the can of FIG. 4.
Figure 6:
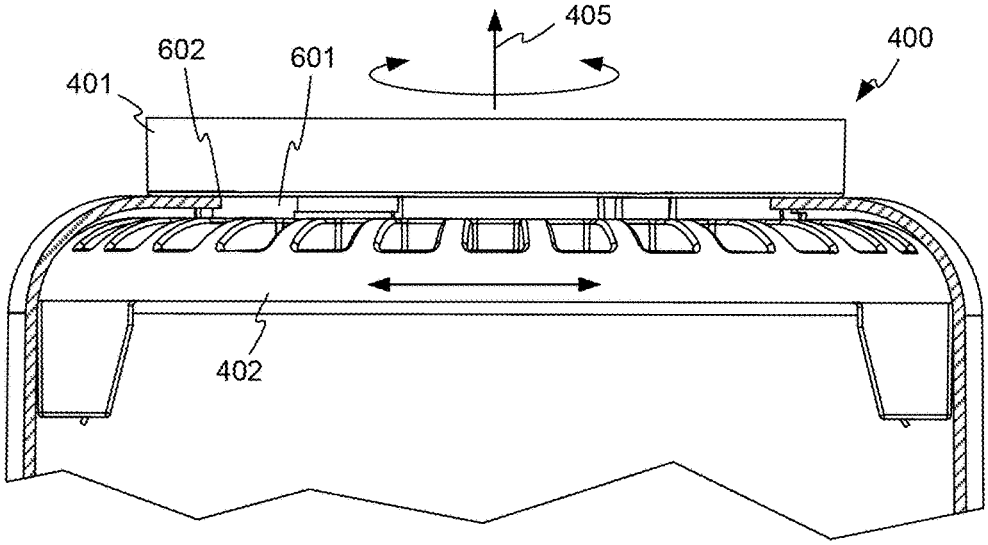
FIG. 6 illustrates a cutaway orthogonal view the top of the can and the rotation mechanism of FIG. 4.

FIG. 4 and FIG. 5 are upper and lower partially-cutaway perspective views of can 104, including a rotation mechanism 400 in accordance with embodiments of the invention. FIG. 6 illustrates a cutaway orthogonal view the top of can 104 and the rotation mechanism 400 after assembly. Referring to FIGS. 4-6, the rotation mechanism includes a rotatable ring 401 and a rotatable disk 402, which can be joined together, one outside can 104 and the other inside can 104. In the example of FIGS. 4-6, rotatable ring 401 is outside can 104 and rotatable disk 402 is inside can 104, but this relationship may be reversed in other embodiments. Rotatable ring 401 and rotatable disk 402 may be attached using fasteners such as screws 403, or by any other suitable means. For example, rotatable ring 401 and rotatable disk 402 may snap together, may be joined using an adhesive, or by other kinds of fasteners such as rivets or bolts. Rotatable ring 401 and rotatable disk 402 may be made of any suitable materials, for example die cast metal, injection molded plastic, or another suitable material. In some embodiments, rotatable ring 401 may snap into hole 404 for ease of assembly.

Once rotatable ring 401 and rotatable disk 402 are joined, their edges define a groove 601 that loosely captures inside edge 602 of hole 404 in the top of can 104, to enable rotation of rotatable ring 401 and rotatable disk 402 together about the vertical axis 405 of can 104 and the center of hole 404.

As shown in FIG. 5, rotatable disk 402 may include features 501 for attaching light engine module 303, as is explained in more detail below.

Figure 7:
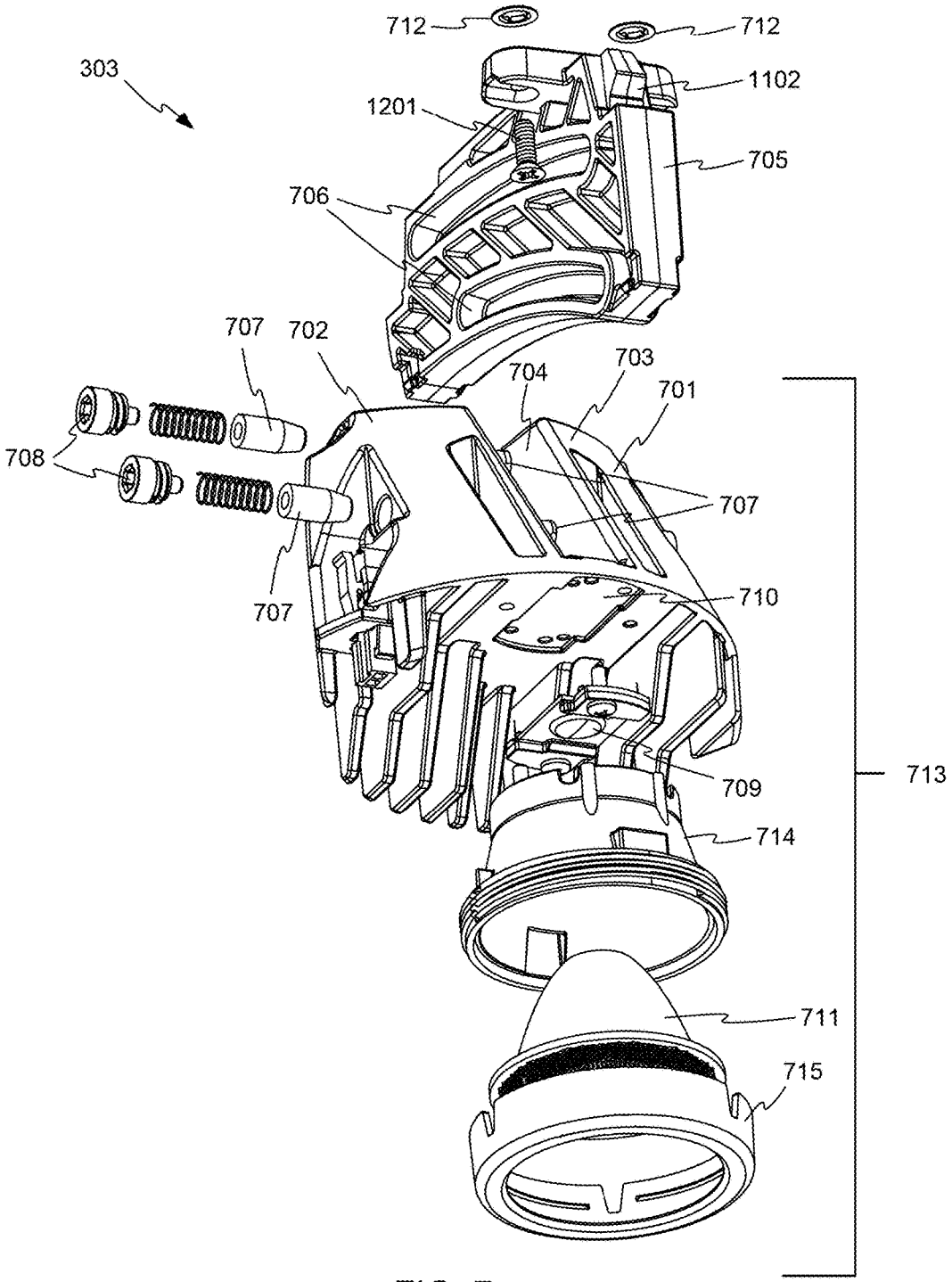
FIG. 7 illustrates an exploded lower perspective view of a tiltable light engine module, in accordance with embodiments of the invention.
Figure 8:
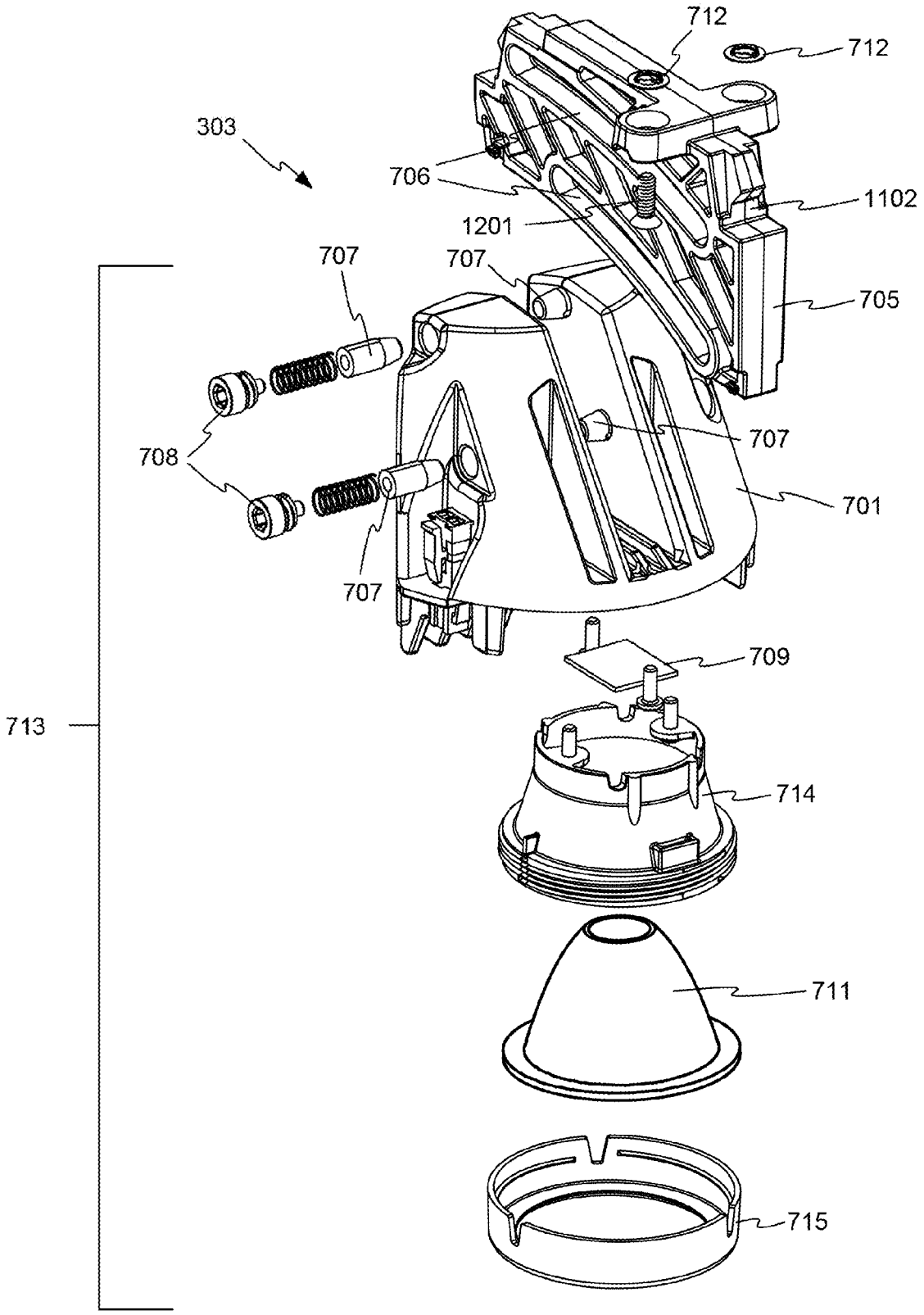
FIG. 8 illustrates an exploded upper perspective view of the tiltable light engine module of FIG. 7.

FIG. 7 illustrates an exploded lower perspective view of tiltable light engine module 303, and FIG. 8 illustrates an exploded upper perspective view of tiltable light engine module 303, in accordance with embodiments of the invention. Referring to both FIGS. 7 and 8, module 303 includes a light engine 713, which may further include a number of components including a heat sink 701. Heat sink 701 has arms 702 and 703, which define an open channel 704 between them. Heat sink 701 may be made, for example, of die cast aluminum or aluminum alloy, or from another suitable material. Heat sink 701 is preferably highly thermally conductive. Light engine 713 further includes a light source 709 (such as, but not limited to one or more light emitting diodes (LEDs)). Light source 709 may be mounted in thermal contact with surface 710 of heat sink 701 when module 303 is fully assembled. Thus, at least some heat generated by light source 709 is conducted into heat sink 701, so as to protect the LEDs. Light engine 713 may also include various other components. In one embodiment, light engine 713 includes a reflector/diffuser unit 711 or another light shaping device for directing light emitted by light source 709 toward a desired location or in a desired pattern. Other components may be present, for example a holder 714 and a bezel 715 for mounting reflector/diffuser unit 711. Other embodiments may include more, fewer, or different components than those shown in the example of FIGS. 7 and 8.

Tiltable light engine module 303 also comprises a module frame 705 shaped and sized to slide within channel 704. Module frame 705 has two side faces, each face defining a pair of curved grooves 706. (Only one side face and pair of grooves are visible in FIGS. 7 and 8.) A pair of protrusions extends though each of the arms of heat sink 701, and the protrusions engage curved grooves 706. In the example of FIGS. 7 and 8, the protrusions are formed by spring-loaded pins 707, which are inserted through the respective arms of heat sink 701 and held in place by screws 708. The protrusions may be removable from, or permanently fixed to, heat sink 701.

In other embodiments, more or fewer grooves 706 may be provided on module frame 705. For example either or both sides of module frame 705 may have three or more grooves 706, or at least one side of module frame 705 may have only one groove 706. In still other embodiments, grooves may be provided on only one side of module frame 705. A corresponding number of protrusions would also be provided. In the embodiment of FIG. 7, grooves 706 are blind grooves having limited depth, but it will be recognized that the grooves may also pass through module frame 705 to form slots. For the purposes of this disclosure, an open slot passing through module frame 705 is considered to form a groove on each side of module frame 705.

When assembled, light engine 713 is rotatable with respect to module frame 705 by sliding the protrusions (e.g. pins 707) within curved grooves 706 in module frame 705.

Figure 9:
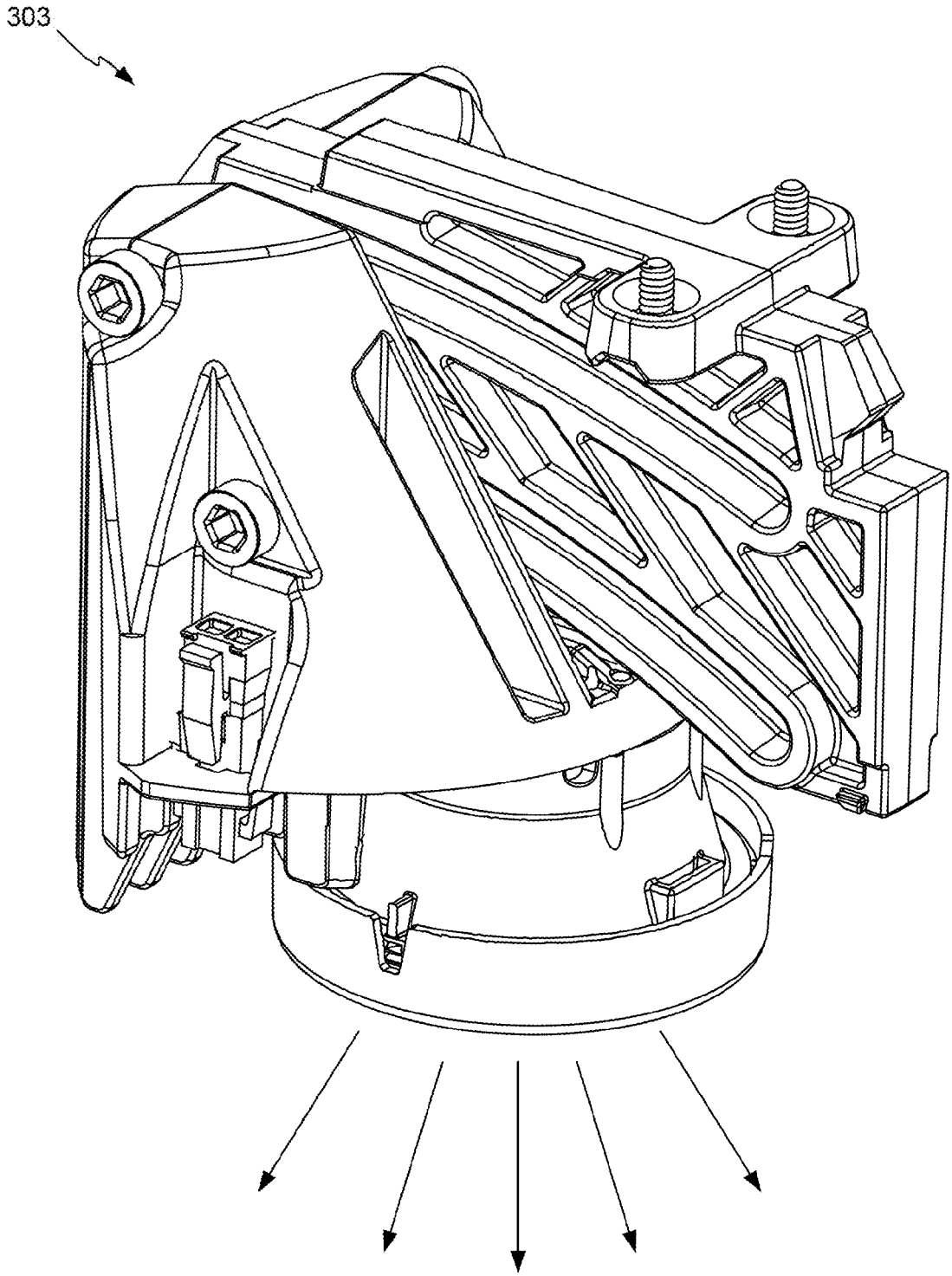
FIG. 9 is a perspective assembled view of the tiltable light engine module of FIG. 7, in accordance with embodiments of the invention.

FIG. 9 illustrates tiltable light engine module 303 fully assembled and configured to direct light substantially downward with respect to the axis of can 104 (not shown).

Figure 10:
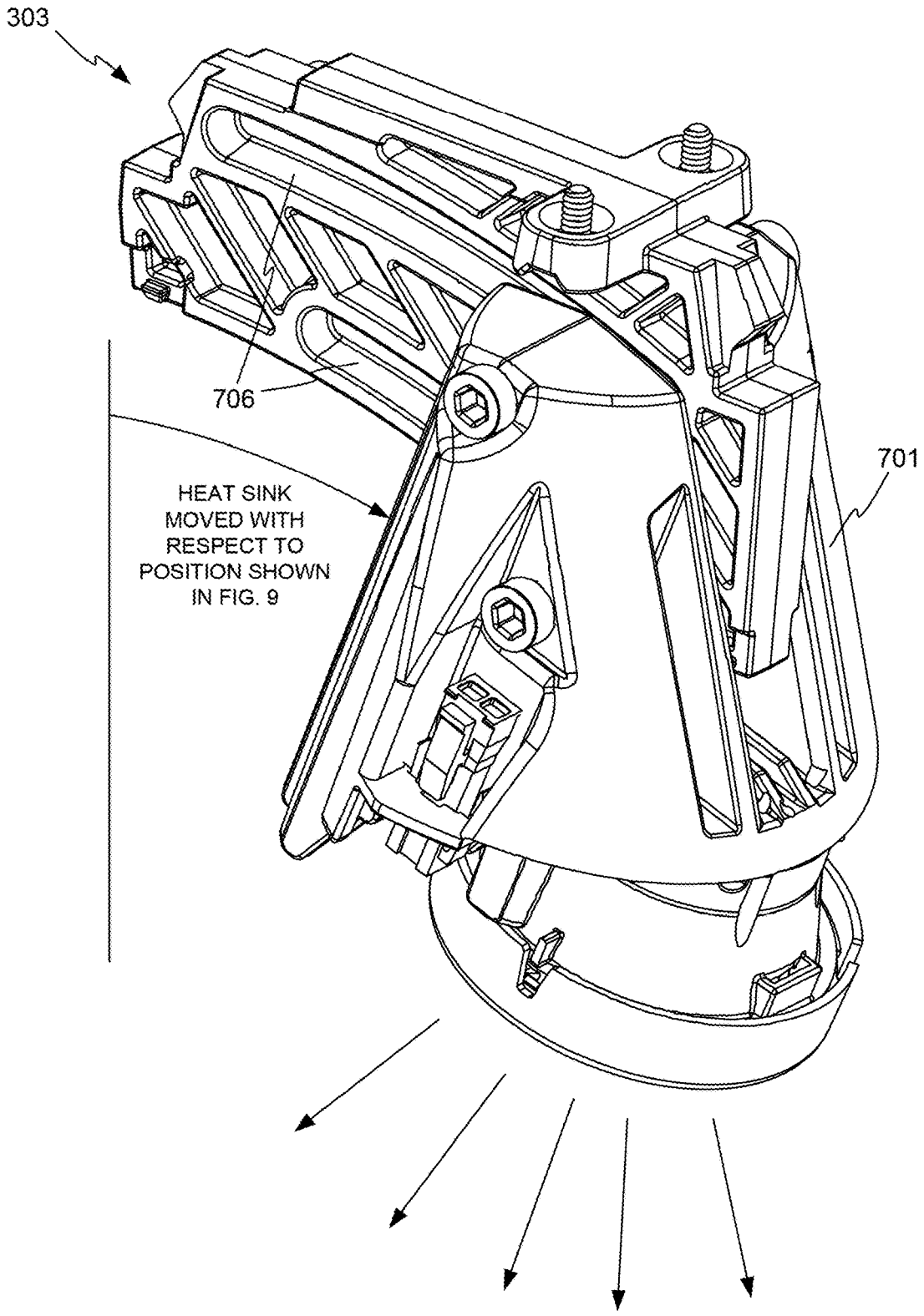
FIG. 10 is a perspective assembled view of the tiltable light engine module of FIG. 7 in a different configuration, in accordance with embodiments of the invention

FIG. 10 illustrates tiltable light engine module 303 fully assembled, and with light engine 713 tilted with respect to the position shown in FIG. 9. In FIG. 10, the pins 707 (not visible) have been slid within grooves 706, to tilt light engine 713 in a first degree of freedom that is a tilt defined by the curvature of grooves 706, thus causing the light emitted by light engine 713 to be directed at an angle with respect to the axis of can 104 (not shown). Grooves 706 may be sufficiently long to permit tilting of module 303 through an angle of, for example, up to 50 degrees. In one embodiment, 35 degrees of tilt are provided. Grooves 706 may not be perfectly circular, and the tilt of light engine 713 may not be exactly about a particular fixed axis. In some embodiments, the grooves may be shaped to cause light engine 713 to drop downward as it tilts, reducing glare on trim 201.

Figure 11:
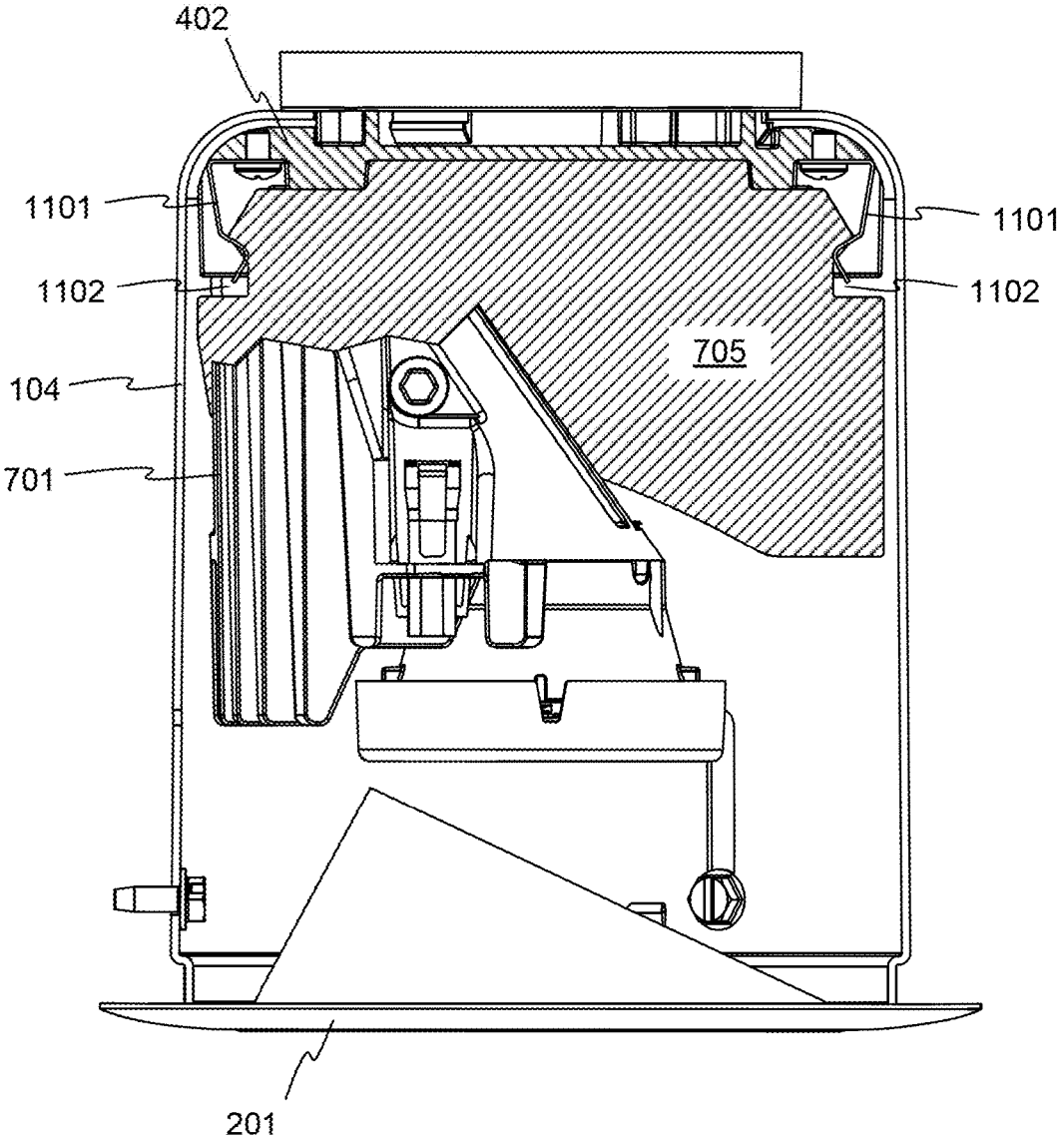
FIG. 11 is a partial section view of the can and tiltable light engine module of FIG. 3, illustrating additional features in accordance with embodiments of the invention.

FIG. 11 is a partial section view of can 104 and tiltable light engine module 303, illustrating additional features in accordance with embodiments of the invention. For example, in FIG. 11, module frame 705, rotatable disk 402, and can 104 have been sectioned vertically along the axis of can 104, and heat sink 701 has been partially cut away to reveal two spring clips 1101 attached to rotatable disk 402. Spring clips 1101 cooperate with notches 1102 formed in module frame 705 to temporarily retain module 303 within can 104 while module frame 705 is more permanently attached to rotatable disk 402 or to rotatable ring 401. For example, tiltable light engine module 303 may be lifted and inserted into can 104 (which has rotatable ring 401 and rotatable disk 402 already installed) until spring clips 1101 snap into notches 1102. Spring clips 1101 are preferably stiff and strong enough to suspend module 303 within can 104. The installer can then have his or her hands free to more permanently attach module frame 705 to, for example, rotatable disk 402.

Figure 12:
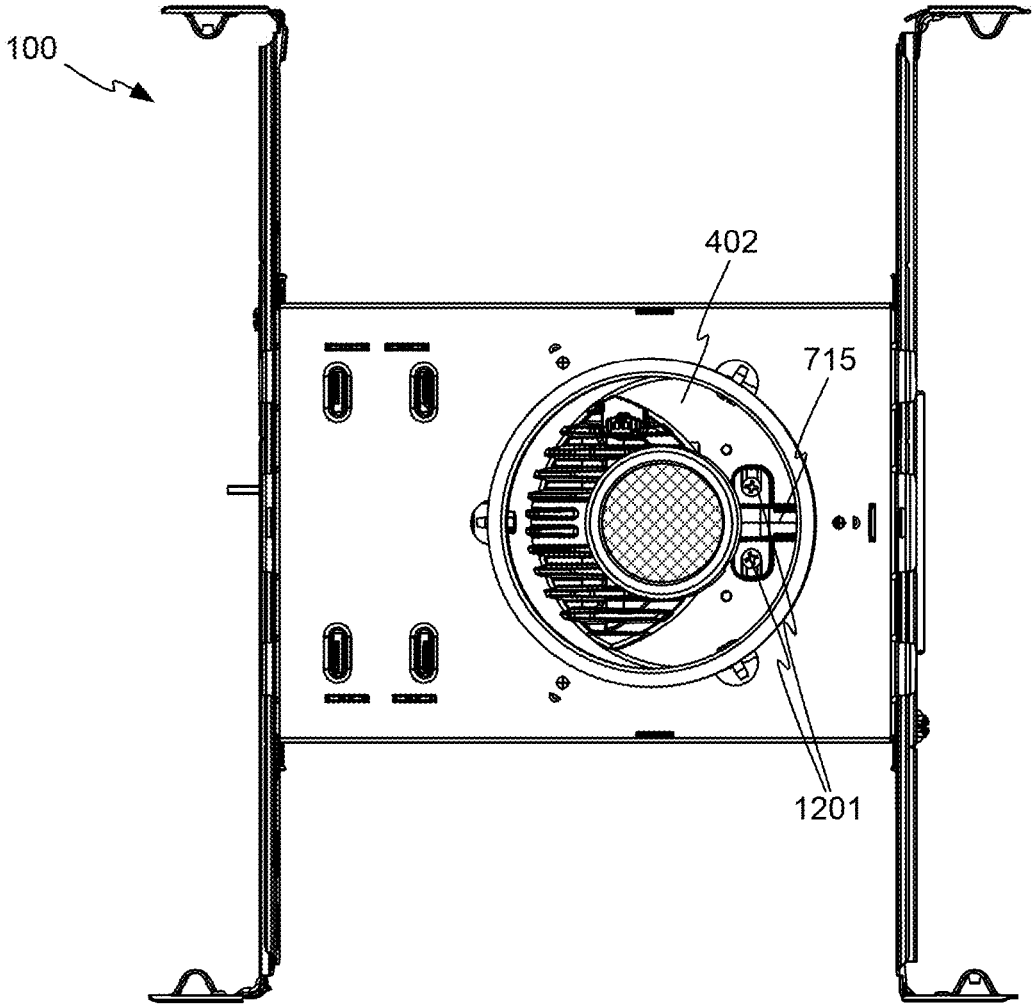
FIG. 12 shows a method of more permanently attaching the tiltable light engine module of FIG. 11 to a rotation mechanism, in accordance with embodiments of the invention.

One method of more permanently attaching module 303 to rotatable disk 402 is shown in FIG. 12, which shows lighting unit 100 from below, before the installation of any trim. In this example, two screws 1201 are positioned to engage holes in rotatable disk 402. Screws 1201 may be retained on module frame 705 during the installation process by clips such as clips 712 shown in FIG. 7. Spring clips 1101 preferably hold module 303 in a position such that screws 1201 are aligned with their respective holes for ease of installation. The holes in rotatable disk 402 may be threaded to receive screws 1201, or may include threaded inserts to receive screws 1201. In other embodiments, the holes may be unthreaded and screws 1201 may be self-tapping screws. In other embodiments, other attachment techniques may be used for assembling module 303 into can 104. In still other embodiments, different numbers of screws may be used, or other kinds of fasteners may be used.

In other installations, tiltable light engine module 303 may be installed within can 104 at the factory. Tiltable light engine module 303 may be removed from can 104 using the reverse of the above procedure, for example for maintenance or repair.

Inclusion of the rotation mechanism 400 (shown in FIGS. 4-6) as well as tiltable light engine module 303 (shown in FIGS. 7-10) enable multiple degrees of freedom for adjusting the position and orientation of light engine 713 and tailoring the emitted light as desired. The tiltability of module 303 permits tilting of the light engine 713 in a first degree of freedom, for example about a first axis, and rotation mechanism 400 permits rotation of module 303 in a second degree of freedom different from the first, for example about a second axis (vertical axis 405) different from the first axis. In some embodiments, the first degree of freedom is defined by the curvature of grooves 706 on module frame 705. In some embodiments, the first axis is substantially horizontal and the second axis is substantially vertical such that the first and second axes are substantially orthogonal to each other.

Figure 13:
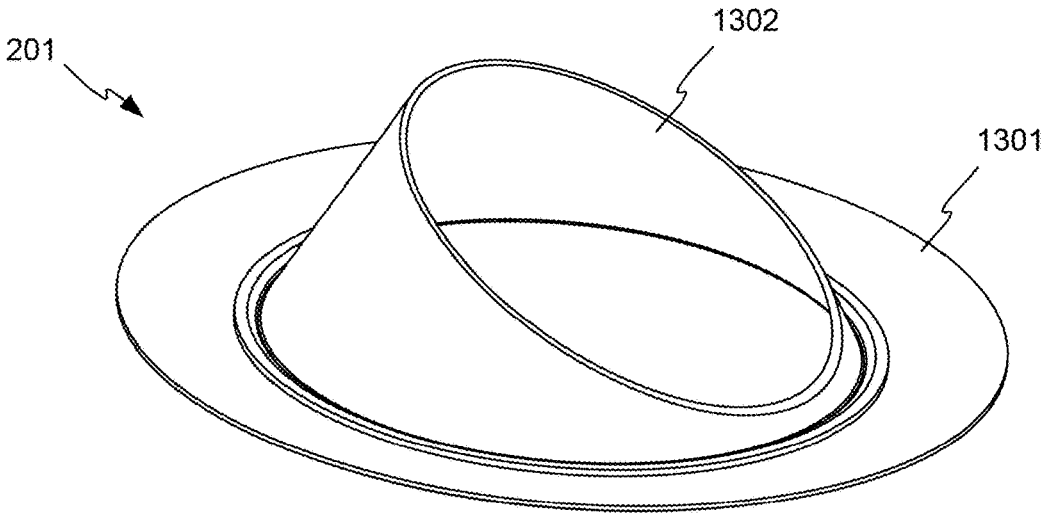
FIG. 13 illustrates a trim in accordance with embodiments of the invention.

Referring again to FIG. 11, trim 201 is visible within can 104. FIG. 13 shows trim 201 in isolation. Trim 201 may be made of a monolithic piece of material or may be assembled from multiple pieces, but in any event includes a bezel 1301 for decoratively covering the edges of a opening over which lighting unit 100 is installed. Trim 201 also includes a raised portion 1302 in the general shape of a frustum of a cone truncated at an angle to the plane of bezel 1301. The angular truncation ensures that raised portion 1302 will not interfere with module 303 in any of its possible angular orientations.

Figure 14:
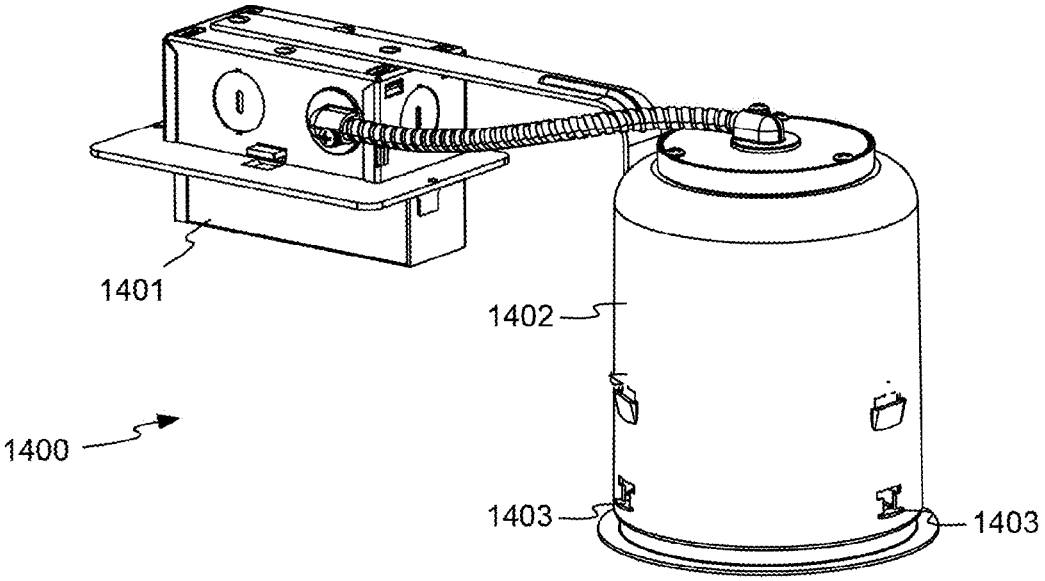
FIG. 14 illustrates a portion of a lighting unit in accordance with other embodiments of the invention.

FIG. 14 illustrates a lighting unit 1400 in accordance with other embodiments of the invention. While lighting unit 100 described above is intended for use in new construction, lighting unit 1400 may be suitable for retrofit installation. Prior to installing lighting unit 1400, an installer may cut a hole in an existing ceiling and bring wiring to the area of the hole. Electrical connections to lighting unit 1400 are made within electrical box 1401, and then electrical box 1401 and can 1402 are inserted through the hole into the space above the ceiling.

Figure 15:
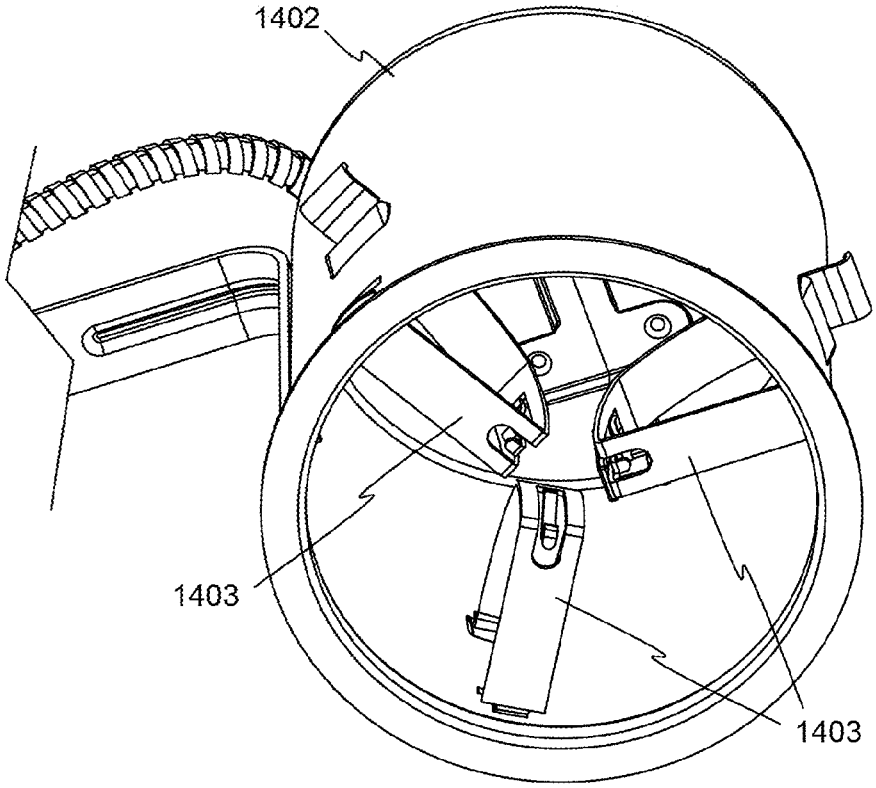
FIG. 15 shows part of the lighting unit of FIG. 14 from a lower perspective, showing remodel springs.

Lighting unit 1400 includes a number of remodel springs 1403 stored within the interior of can 1402, so that remodel springs 1403 are carried into the space above the ceiling as can 1402 is passed through the hole. FIG. 15 shows part of lighting unit 1400 from a lower perspective, showing remodel springs 1403 stored within can 1402. Remodel springs 1403 may be made, for example, of spring steel or another suitable material.

Figure 16:
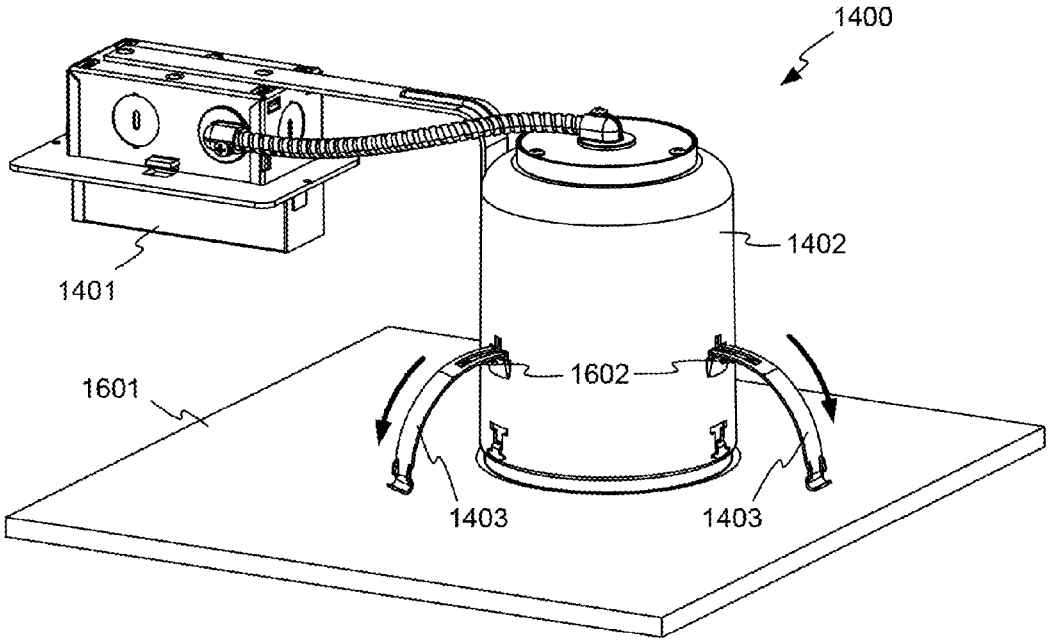
FIG. 16 illustrates an upper perspective view of the lighting unit of FIG. 14 after installation above a ceiling.

FIG. 16 illustrates an upper perspective view of lighting unit 1400 after installation above a ceiling 1601. Once electrical box 1401 and can 1402 are in position above ceiling 1601, remodel springs 1403 are deployed by pushing them outward from inside the can until they contact ceiling 1601 from above. Preferably, remodel springs 1403 are designed such that they contact ceiling 1601 and remain in a state of spring tension to hold can 1401 tightly upward against ceiling 1601. Remodel springs 1403 may be provided with locking features 1602 to hold them in the deployed position.

Figure 16A:
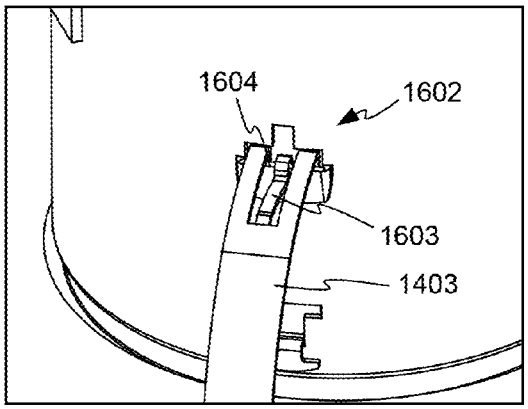
FIGS. 16A and 16B show locking features of the lighting unit of FIG. 14, in accordance with embodiments of the invention.
Figure 16B:
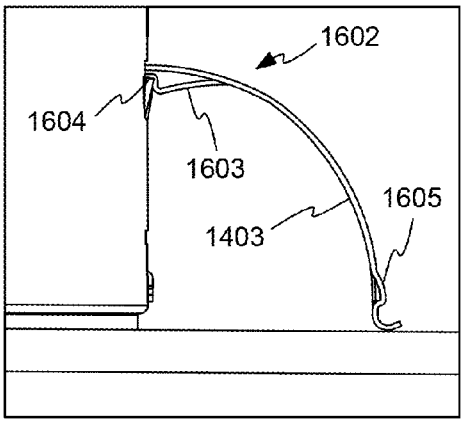

FIGS. 16A and 16B show locking features 1602 in more detail, in accordance with embodiments of the invention, in oblique and orthogonal views. A ramp 1603 is formed in each of remodel springs 1403, and a lip 1604 is formed in the wall of can 1402 at each penetration of one of remodel springs 1403. As each remodel spring 1403 is deployed, ramp 1603 deflects and snaps over lip 1604, locking remodel spring 1403 in the deployed position. A similar feature 1605 may be provided for holding remodel spring 1403 in the retracted position inside can 1402. Remodel springs 1403 may be moved between the deployed and retracted positions manually disengaging locking features 1602 from inside can 1402 or by manually overcoming the detent action of features 1605.

Once remodel springs 1403 are deployed, the interior of can 1401 is substantially unobstructed, permitting the installation of a light engine module such as tiltable light engine module 303 in the interior of can 1401, for example in the manner described above.

Figure 17:
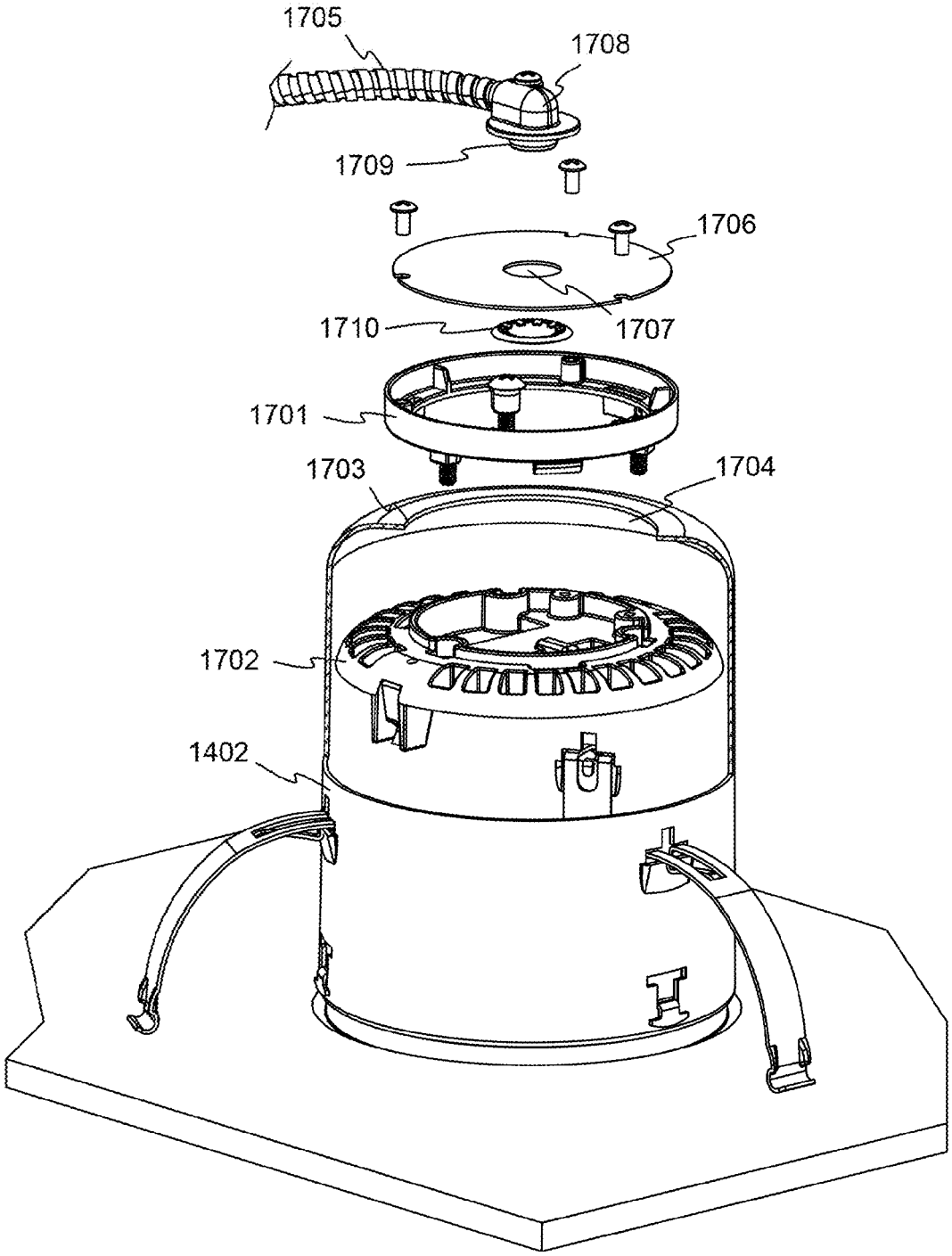
FIG. 17 illustrates an exploded and partially cutaway perspective view of a can and rotation mechanism of the lighting unit of FIG. 14.

FIG. 17 illustrates an exploded and partially cutaway perspective view of can 1402 and a rotation mechanism within can 1402. Lighting unit 1400 includes a rotation mechanism which may be similar to rotation mechanism 400 discussed above. The rotation mechanism includes a rotatable ring 1701 and a rotatable disk 1702 that cooperate to capture inside edge 1703 of hole 1704 in the top of can 1402. A tiltable light engine module such as tiltable light engine module 303 may be attached to rotatable ring 1701 or rotatable disk 1702 in a manner similar to that previously discussed. Power for the tiltable light engine module may be provided by wires (not shown) through conduit 1705 from electrical box 1401 (not visible in FIG. 17). In order to provide sealing of can 1402 and free rotation of the light engine in can 1402, a lid such as lid 1706 may be attached to rotatable ring 1701. Example lid 1706 defines an opening 1707 for receiving the wires and for coupling to conduit 1705. Conduit 1705 may be coupled to opening 1707 in a way that permits lid 1706 to rotate with respect to conduit 1705. For example, in FIG. 17, a fitting 1708 at the end of conduit 1705 includes a depending hollow cylinder 1709 that can extend through opening 1707. The outer diameter of cylinder 1709 is preferably smaller than the inner diameter of opening 1707, such that lid 1706 can freely rotate about cylinder 1709. Cylinder 1709 may be retained within opening 1707 by any convenient method, for example using a retaining washer 1710 sized to press onto cylinder 1709.

The arrangement of FIG. 17 permits rotatable disk 1702 (as well as the tiltable light engine module attached to it) to rotate within can 1402 without requiring twisting or bending of conduit 1705. In other embodiments, conduit 1705 may rotatably couple directly to rotatable disk 1702, for example through an opening defined in rotatable disk 1702. The light engine may also be tilted about a second axis as described above.

Figure 18:
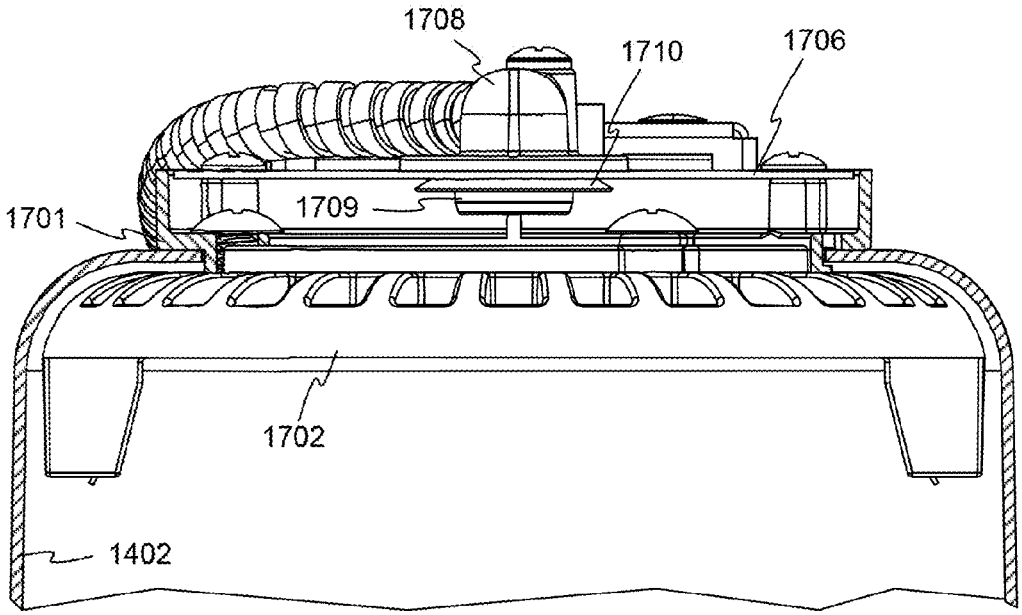
FIG. 18 illustrates a partially cutaway assembled of view of the can and rotation mechanism of the lighting unit of FIG. 14

FIG. 18 illustrates a partially cutaway assembled view of can 1402 and its rotation mechanism. Retaining washer 1710 retains fitting 1807 to lid 1706 by engaging with depending cylinder 1709.

The invention has now been described in detail for the purposes of clarity and understanding. However, those skilled in the art will appreciate that certain changes and modifications may be practiced within the scope of the appended claims.

What is claimed is:

1. A lighting unit, comprising:

a light engine comprising a light source and a heat sink, the heat sink attached to and in thermal communication with the light source, the heat sink comprising first and second arms defining an open channel between the first and second arms;

a module frame shaped and sized to slide within the open channel of the heat sink, the module frame having first and second sides and defining a first pair of curved grooves in the first side of the module frame and a second pair of curved grooves in the second side of the module frame; and at least four protrusions, two of the protrusions extending from the first arm of the heat sink and respectively engaging the first pair of curved grooves, and two of the removable protrusions extending from the second arm of the heat sink and respectively engaging the second pair of curved grooves, wherein the light engine is tiltable with respect to the module frame by sliding the protrusions within the pairs of grooves.

2. The lighting unit of claim 1, wherein the at least four protrusions are removable from the heat sink.

3. The lighting unit of claim 1, wherein the protrusions are spring-loaded pins.

4. The lighting unit of claim 1, wherein the light engine is tiltable in a first degree of freedom defined by the curvature of the curved grooves, the lighting unit further comprising:

a can of a size and shape to enclose the light engine and the module frame; and a rotation mechanism attached to the module frame and to the can, the rotation mechanism enabling rotation of the light engine and the module frame in a second degree of freedom different from the first degree of freedom.

5. The lighting unit of claim 4, wherein the first and second degrees of freedom are rotations about first and second axes that are orthogonal.

6. The lighting unit of claim 5, wherein the first axis is horizontal and the second axis is vertical.

7. The lighting unit of claim 4, wherein an edge of the can defines a hole in an end of the can, and wherein the rotation mechanism further comprises:

a rotatable ring; and a rotatable disk, the rotatable ring and rotatable disk joined together and defining a groove that captures the edge of the can defining the hole to enable rotation of the rotatable ring and rotatable disk together about the center of the hole, wherein the module frame attaches to the rotatable disk or to the rotatable ring.

8. The lighting unit of claim 7, further comprising two or more spring clips attached to the rotatable disk or to the rotatable ring and shaped and positioned to temporarily retain the module frame within the can while the module frame is attached to the rotatable disk or to the rotatable ring.

9. The lighting unit of claim 4, wherein the can is generally cylindrical, and wherein an outer wall of the can defines two or more slots having their long axes parallel to the axis of the can.

10. The lighting unit of claim 1, further comprising:

a can of a size and shape to enclose the light engine and the module frame; and two or more remodel springs configured to be deployed from an interior of the can to hold the can against a ceiling.

11. The lighting unit of claim 10, wherein an edge of the can defines a hole and the lighting unit further comprises a rotation mechanism, wherein the rotation mechanism further comprises:

a rotatable ring; and a rotatable disk, the rotatable ring and rotatable disk joined together and defining a groove that captures the edge of the can defining the hole to enable rotation of the rotatable ring and rotatable disk about the center of the hole, wherein the module frame attaches to the rotatable disk or to the rotatable ring.

12. The lighting unit of claim 11, further comprising a conduit through which wires reach the can.

13. The lighting unit of claim 12, further comprising a lid attached to the rotatable ring, the lid defining an opening through which the wires reach the interior of the can, wherein the conduit rotatably couples to the lid.

14. The lighting unit of claim 12, wherein the conduit rotatably couples to the rotatable disk.

15. The lighting unit of claim 1, further comprising:

a generally cylindrical can of a size and shape to enclose the light engine and the module frame; and a trim configured to cover a bottom end of the can when the can is installed in a ceiling, the trim further comprising an annular bezel having an inner edge defining an opening and a protruding portion extending from the inner edge, the protruding portion being in the shape of a frustum of a cone.

16. The lighting unit of claim 15, wherein the frustum of the cone is truncated at an angle with respect to the annular bezel.

17. A method of assembling a lighting unit, the method comprising:

installing a can at least partially above a ceiling, the can comprising at least two spring clips;

inserting a light engine module into the can, the light engine module defining clip receiving features for receiving the spring clips;

engaging the clip receiving features with the spring clips to temporarily hold the a light engine module within the can; and installing fasteners to permanently hold the light engine module within the can.

18. The method of claim 17, wherein the light engine module is a tiltable light engine module, and wherein the can comprises a rotation mechanism enabling rotation of the tiltable light engine module about an axis of the can, the method further comprising:

rotating the tiltable light engine module about the axis of the can using the rotation mechanism; and tilting a portion the tiltable light engine in a degree of freedom orthogonal to the axis of the can to aim light emitted by the tiltable light engine module.

19. The method of claim 18, wherein the tiltable light engine module comprises a heat sink and a module frame attached to the rotation mechanism, and wherein tilting a portion of the tiltable light engine module comprises sliding the heat sink comprised in the tiltable light engine module along grooves provided in the module frame.

* * * * *